United States Patent [19]

Kolkhorst

[11] Patent Number: 4,732,521

[45] Date of Patent: Mar. 22, 1988

[54] SETTING DEVICE FOR PASTING ROLLERS IN A BOOK CASING MACHINE

[75] Inventor: Helmut Kolkhorst, Rahden, Fed. Rep. of Germany

[73] Assignee: Kolbus GmbH & Co. KG, Rahden, Fed. Rep. of Germany

[21] Appl. No.: 40,937

[22] Filed: Apr. 21, 1987

[30] Foreign Application Priority Data

Apr. 26, 1986 [DE] Fed. Rep. of Germany ..... 3614254

[51] Int. Cl.[4] ..... B42C 9/00

[52] U.S. Cl. ..... 412/1; 493/478; 412/9

[58] Field of Search ..... 412/1, 9, 14, 37; 493/478, 479

[56] References Cited

U.S. PATENT DOCUMENTS 3,689,352 9/1972 Sugioka ..... 412/14

FOREIGN PATENT DOCUMENTS 232465 1/1986 German Democratic Rep. ... 412/14

*Primary Examiner*—Paul A. Bell

*Attorney, Agent, or Firm*—Chilton, Alix & Van Kirk

[57] ABSTRACT

Apparatus for setting the pasting rollers in book casing machines. This setting apparatus features a position indicator 2 that is installed outside the fold-pasting unit 3, to which position indicator 2 a fold angle 1*a* of a book block 1 can be aligned. When this angle 1*a* is set to the same height as the indicator, the position of the book block represents the datum zero position of the conveyor. The leading edge 6*b* of the recess 6*a* in the pasting roller 6 can then be set, in that the pasting roller drive has a position mark 10 which corresponds to the leading edge 6*b* of the roller recess 6*a*, enabling this drive to be brought into register with a mark 7 corresponding to the datum zero position of the conveyor.

18 Claims, 14 Drawing Figures

SETTING DEVICE FOR PASTING ROLLERS IN A BOOK CASING MACHINE

BACKGROUND OF THE INVENTION

The invention relates to a device for setting the pasting rollers in book casing machines.

Machines of this type possess an endless, power-driven conveyor having horizontally aligned saddle plates, and pasting rollers that are installed on both sides of the path on which the saddle plates move. The pasting rollers have recesses which are configured in a manner such that their leading edges fit into the fold angles of a book block, and can be adjusted so as to correspond to the height at which the fold angles of a book block, supported astride the saddle plate, are situated under a given set of conditions.

In known devices for setting pasting rollers, of the above-mentioned type, the leading edge of the roller recess is matched with the fold angle of a book block which, supported on the conveyor saddle plate, has been moved into a datum position. This alignment operation is carried out by disconnecting the pasting roller driving disk from the main drive. The adjustment operation takes place in the immediate vicinity of the pasting unit, and because accessibility is poor, it has to be performed under visibility conditions that are less than optimum. Setting-up is consequently not only time-consuming, but can additionally lead to inaccuracies in the matching of the roller recess to the fold angle.

SUMMARY OF THE INVENTION

It is thus an object of the present invention to improve the adjustment operation of the setting device for pasting rollers in terms of shortening the machine change-over times and increasing the accuracy.

The invention achieves its object by utilizing a position indicator which is installed outside the pasting unit, and to which the fold angle of a book block can be aligned. This angle is used to set the position of the rollers so that the leading edge of the recess matches the book block angle. The alignment of the book block with the indicator represents the datum zero position of the conveyor, to which position the leading edge of the recess in the pasting roller can be set. The pasting-roller drive has a position mark which corresponds to the leading edge of the roller recess, enabling this drive to be brought into register with a mark corresponding to the datum zero position of the conveyor.

BRIEF DESCRIPTION OF THE DRAWINGS

In the paragraphs which follow, the invention is explained in more detail, by reference to an illustrative embodiment, and to the accompanying drawings, in which.

DESCRIPTION OF THE PREFERRED EMBODIMENT

Figure 1:
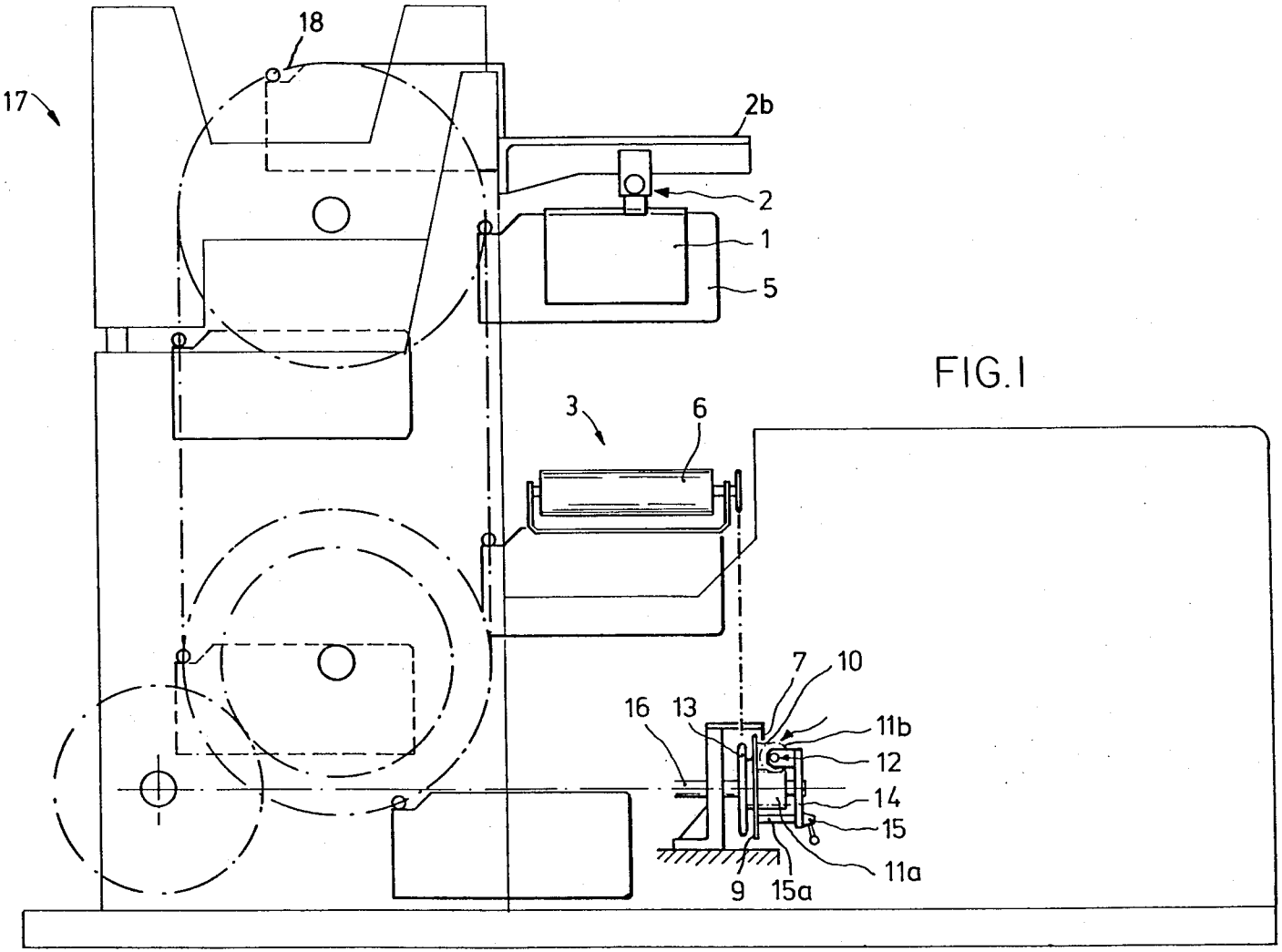
FIG. 1 is a front view of a portion of a book casing machine having pasting rollers and a device for setting the pasting rollers, in accordance with the present invention.

FIG. 1 shows the portion of a book casing machine 17 having a fold pasting unit 3. The conveyor unit 18 is of a conventional, generic type, and forms no part of the present invention. The unit 18 has a plurality of conveyor plates 5 connected to an endless chain which is driven such that the plates engage a book block 1 at a given station and raise the book block through a fold pasting unit 3, subsequent to which a book casing (not shown) is placed onto the pasted book block.

Figure 2B:
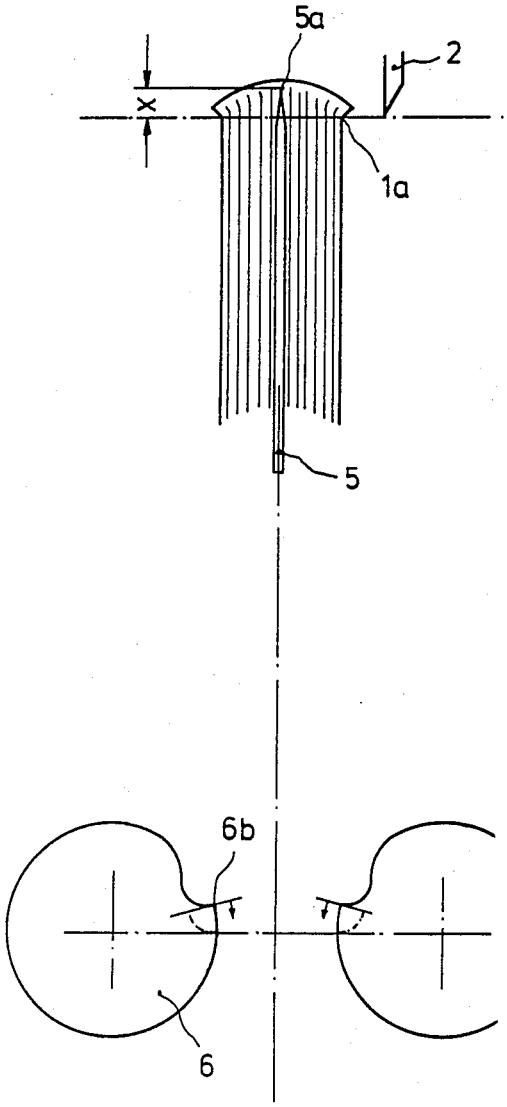
FIG. 2*b* is a diagrammatic side view of the type shown in FIG. 2*a*, wherein the book back is rounded, the raised center of the book back forming angle at the juncture with the cover, which requires adjustment of the angle of the leading edge of the rollers relative to their positions shown in FIG. 2(*a*).
Figure 2A:
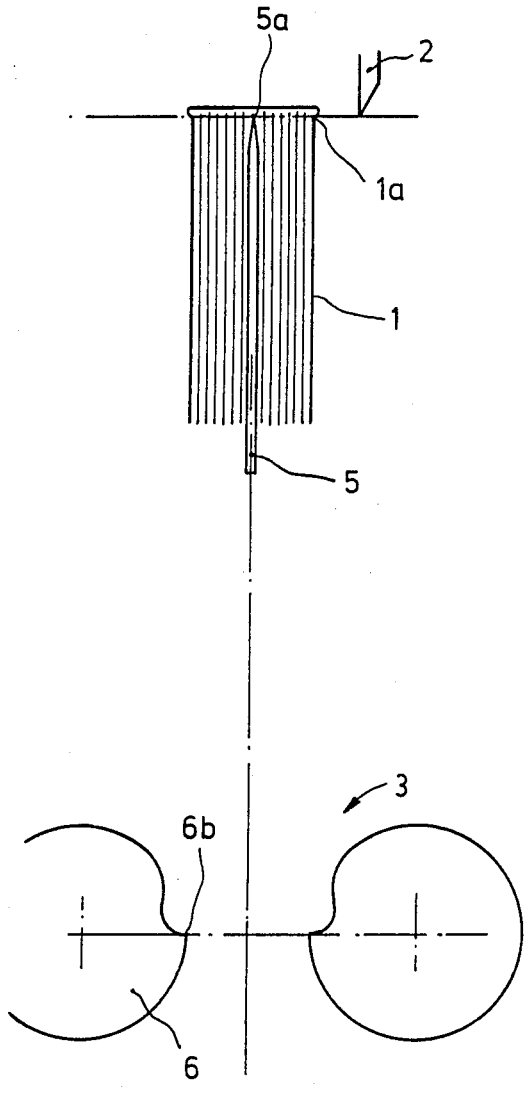
FIG. 2*a* is a diagrammatic side view, taken from the right of FIG. 1, showing the base adjustment of the rollers relative to an book block having a flat back.
Figure 3:
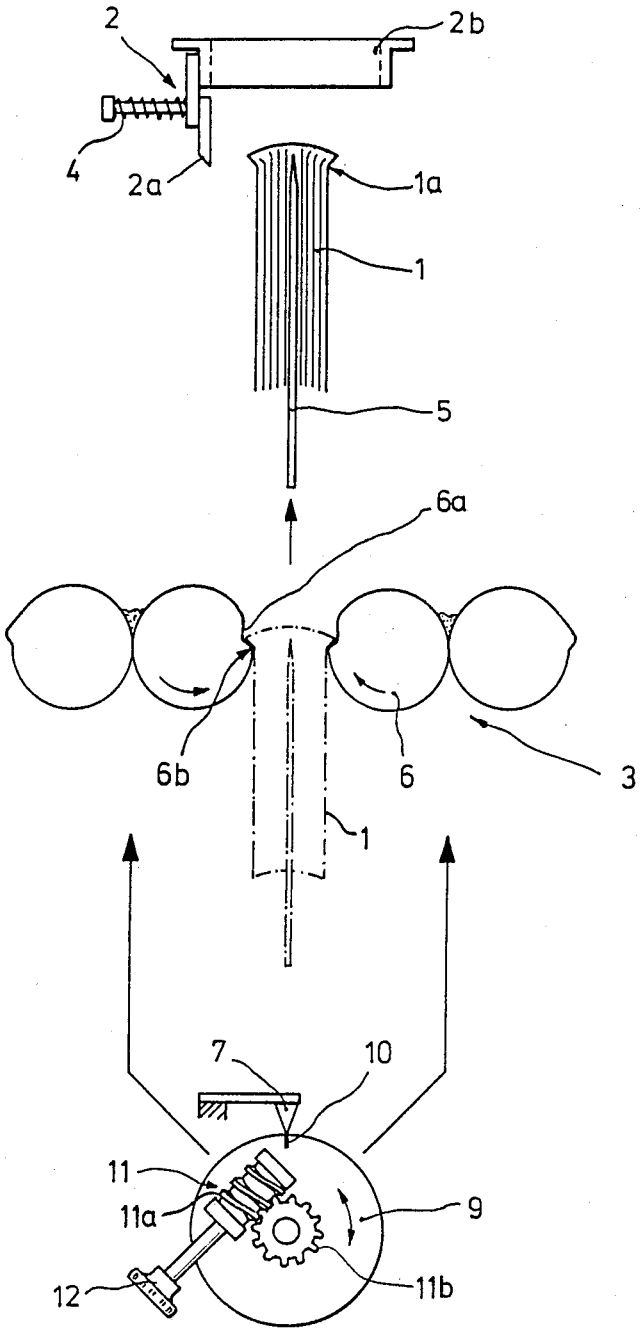
FIG. 3 is a diagrammatic view, taken from the right of FIG. 1, showing the relationship of the indicator, the rollers, and the adjustment mechanism.

As shown in FIGS. 2 and 3, each conveyor plate 5 serves as a saddle for a book block, the upper edge 5*a* of plate 5 carrying the dead weight of the book block 1. As may be understood with reference to FIGS. 1 and 3, the conveyor plate raises a book block along a path passing between a pair of pasting rollers 6, each pasting roller having a recess 6*a* which is configured in a manner such that its associated leading edge 6*b* fits into the fold angle 1*a* of the book block 1.

Fold-pasting units of this type are subject to a requirement that it must be possible to set the leading edges 6*b* of the pasting rollers 6 to precisely the same height as the fold angles of the book block 1. In order to apply glue or paste to the joint or angle area 1*a* of an upward moving book block, the leading edge 6*b* of the pasting roller must mate with the angle of the joint 1*a*. FIGS. 2*a* and 2*b* illustrate the results of this adjustment in accordance with the invention. In FIG. 2*a*, the plate 5 and leading edge 6*b* are coordinated in a base or reference case associated with a book block having a flat back. These are the conveyor and roller datum zero positions.

For a book block having a rounded back as shown in FIG. 2*b*, when the fold angle 1*a* is positioned at the same elevation as the fold in FIG. 2*a*, the edge 5*a* of the saddle plate 5 is located a distance X above the corresponding position associated with the plate edge in FIG. 2*a*. Since the chain drive of the conveyor unit 18 and the chain drive of the fold pasting unit 3 are connected to a common drive (not shown), the leading edge 6*b* of the pasting rollers 6 in FIG. 2*b* is also at a slightly higher, or more advanced rotational position than the base position in FIG. 2*a*. In order for the leading edge 6*b* of the roller to properly engage the fold angle 1*a* of a book block having a rounded back such as shown in FIG. 2*b*, the datum zero, or neutral, position of the rollers 6 must be adjusted downward in the direction of the arrows shown in FIG. 2*b*. The leading edge 6*b* will then engage the fold angle 1*a* at the appropriate moment during the movement of the book block vertically through the fold pasting unit 3.

Thus, it is required that the leading edges 6*b* of the pasting rollers 6 be settable to precisely the same height as the fold angles of the book block 1. In conventional pasting units, this adjustment operation could be performed only under difficult conditions, created by poor accessibility.

According to the invention, a position indicator 2 is installed above the pasting rollers 6, at an easily accessible location such as machine frame beam 2*b*. The position indicator 2 preferably has the form of a finger or the like that can be pushed by hand transversely to the plane in which the book blocks are conveyed, and against the action of a spring element 4.

When the format of the book backs to be introduced to the machine changes, the operator places a sample new format book block on a conveyor plate 5 and operates the conveyor unit until the book block reaches the conveyor datum zero position indicated by the fingers 2*a*, as shown in FIGS. 2*a* or 2*b*. There exists defines a fixed relationship between the edge 5*a* of the upper saddle plate in the vicinity of the position indicator 2 and the position of the next lower saddle plate which is situated between the rollers 6. Thus, the datum zero elevation of the plates 5 varies according to the book block format. The datum zero position of the conveyor is permanently denoted by a datum mark 7, the purpose of which will be more fully described below.

In order to place the conveyor in the datum zero position, the operator pushes on the spring element 4 of the position indicator 2 such that the finger 2*a* which is preferably disposed at eye level, is urged into close proximity to the fold angle 1*a*. The fold angle 1*a* of the book block is aligned, by eye, so that the fold angle is at the same elevation as the point or other indicia on finger 2*a*. This is accomplished by incrementally moving the conveyor up or down until the fold angle 1*a* is aligned with the indicia on indicator 2.

FIG. 1 shows the adjusting mechanism 19 which, utilized in conjunction with the position indicator 2, enables the operator to adjust the rollers 6 in the accurate and efficient manner which distinguishes the present invention from known techniques. The datum zero condition of the conveyor is indicated by mark 7 as a fixed point on the frame of adjusting mechanism 19. In order to enable the pasting roller 6 to be aligned at its leading edge 6*b*, use is made of a driving disk 9 by which the pasting roller 6 is driven, the disk having a position mark 10 which corresponds to the leading edge 6*b* of the roller recess 6*a*. When the position mark 10 is brought into registry with the conveyor datum zero position mark 7, the leading edge 6*b* has been properly adjusted back from, for example, the position shown in FIG. 2*b* to the position shown in FIG. 2*a*. This adjustment is performed by, for example, the hand wheel 12 connected to a worm gear 11*a* and worm wheel 11*b* arrangement 11 for adjusting the driving disk 9.

During the adjustment by means of the hand wheel 12, the pasting rollers 6 are uncoupled from the common drive with the conveyor. Preferably, the adjusting mechanism 19 has a chain wheel 13, disk 9 and gear wheel 11*a* connected to one another for adjusting the free pivot on shaft 16. The disk 14 having the worm wheel 11*b* is fixed to shaft 16. Drive chain wheel 13 and disk 9 are coupled with the disk 14 by clamp lever 15 and bar 15*a* fixed to the disk 9. For adjusting the chain wheel 13 and disk 9 with bar 15*a*, a slot in the disk is necessary. The driving disk is then reconnected to the common drive with the conveyor unit 18, whereby the endless chain for conveying the plates 5 and the pasting rollers 6 are continuously operated to paste the bookcases having the new format.

I claim:

1. Apparatus for setting the pasting rollers in a book case machine, the machine having an endless, power-driven conveyor with horizontally oriented saddle plates engaging a book block on a transport path, comprising:

a pasting unit including a pair of horizontally disposed pasting rollers located on both sides of the path of the saddle plates, the rollers including recesses which are configured with leading edges adapted to fit into the fold angles of a book block:

first means external to the pasting unit, for indicating when the fold angles of a book block carried by a saddle plate are aligned with a reference elevation:

second means, coupled to the pasting unit, for indicating when the leading edges of the rollers are in a reference angular position:

third means, associated with said conveyor, for raising and lowering the saddle plate along said path and stopping the plate when said fold angle is at said reference elevation; and fourth means, coupled to said second means, for rotating the rollers independently of the conveyor until the leading edges of the rollers are in said reference position when the fold angle is at said reference elevation.

2. The apparatus of claim 1 wherein the path of the saddle plates between said rollers is vertical, and wherein said first means is located at a fixed position above the pasting unit.

3. The apparatus of claim 2 wherein said first means is mounted on a beam on the casing machine.

4. The apparatus of claim 3 wherein said first means comprises a position finger which is mounted at eye level for transverse movement by hand against the action of the spring.

5. The apparatus of claim 1 wherein said second means includes a driving disk by which the pasting rollers are normally driven, a position mark on the driving disk for rotation therewith, and a stationary mark adjacent said driving disk for cooperating with said position mark to indicate when the leading edges of the rollers are in said reference angular position.

6. The apparatus of claim 5 wherein said fourth means includes a manually operable gear mechanism for moving the driving disk independently of the conveyor.

7. The apparatus of claim 6 wherein said conveyor and said pasting unit are driven by a common drive and wherein said fourth means includes means for selectively decoupling said driving disk from said common drive.

8. The apparatus of claim 6 wherein said second means and said fourth means are embodied in an adjustment mechanism situated remotely from said pasting unit.

9. The apparatus of claim 8 wherein said adjustment mechanism is connected to said pasting unit by means of a chain connecting the driving disk 9 to a driven disk on the rollers.

10. The apparatus of claim 8 wherein the path of the saddle plates between said rollers is vertical, and wherein said first means is located at a fixed position above the pasting unit.

11. The apparatus of claim 10 wherein the first means is mounted on a beam on the casing machine.

12. The apparatus of claim 5 wherein the path of the saddle plates between said rollers is vertical, and wherein said first means is located at a fixed position above the pasting unit.

13. The apparatus of claim 6 wherein the path of the saddle plates between said rollers is vertical, and wherein said first means is located at a fixed position above the pasting unit.

14. A method of operating the apparatus of claim 12, including the steps of:

utilizing said third means to align the fold angle on a book back with said reference elevation as indicated by said first means;

observing the location of said position mark relative to said stationary mark associated with said second means;

while the fold angle of the book block is aligned with said referenced elevation, utilizing said fourth means to rotate the rollers until the leading edge of the rollers is in said reference position;

thereby setting the rollers according to the height of the book back.

15. A method of operating the apparatus of claim 7, including the steps of:

utilizing said third means to align the fold angle on a book back with said reference elevation as indicated by said first means;

observing the location of said position mark relative to said stationary mark associated with said second means;

while the fold angle of the book block is aligned with said referenced elevation, utilizing said fourth means to rotate the rollers until the leading edge of the rollers is in said reference position;

thereby setting the rollers according to the height of the book back.

16. A method for operating the apparatus of claim 13, including the steps of:

utilizing said third means to align the fold angle on a book back with said reference elevation as indicated by said first means;

observing the location of said position mark relative to said stationary mark associated with said second means;

while the fold angle of the book block is aligned with said referenced elevation, utilizing said fourth means to rotate the rollers until the leading edge of the rollers is in said reference position;

thereby setting the rollers according to the height of the book back.

17. A method of operating the apparatus of claim 8, including the steps of:

utilizing said third means to align the fold angle on a book back with said reference elevation as indicated by said first means;

observing the location of said position mark relative to said stationary mark associated with said second means;

while the fold angle of the book block is aligned with said referenced elevation, utilizing said fourth means to rotate the rollers until the leading edge of the rollers is in said reference position;

thereby setting the rollers according to the height of the book back.

18. A method of operating the apparatus of claim 11, including the steps of:

utilizing said third means to align the fold angle on a book back with said reference elevation as indicated by said first means;

observing the location of said position mark relative to said stationary mark associated with said second means;

while the fold angle of the book block is aligned with said referenced elevation, utilizing said fourth means to rotate the rollers until the leading edge of the rollers is in said reference position;

thereby setting the rollers according to the height of the book back.

* * * * *